US006341734B1

(12) United States Patent
Van Der Steur

(10) Patent No.: US 6,341,734 B1
(45) Date of Patent: Jan. 29, 2002

(54) ROTARY ATOMIZER AND BELL CUP AND METHODS THEREOF

(75) Inventor: Gunnar Van Der Steur, Churchville, MD (US)

(73) Assignee: EFC Systems, Inc., Havre de Grace, MD (US)

( * ) Notice: Subject to any disclaimer, the term of this patent is extended or adjusted under 35 U.S.C. 154(b) by 0 days.

(21) Appl. No.: 09/691,198

(22) Filed: Oct. 19, 2000

(51) Int. Cl.[7] ..... B05B 15/02; B05B 3/02; B05B 3/10; B44D 5/10; F23D 11/34

(52) U.S. Cl. ..... 239/223; 239/112; 239/222; 239/224

(58) Field of Search ..... 239/220, 223, 239/224, 112, 104, 106, 214.25, 290, 296, 700, 703, 222; 285/243, 255, 322, 323, 242; 137/360

(56) References Cited

U.S. PATENT DOCUMENTS

| | | | | |
|---|---|---|---|---|
| 3,504,851 A | | 4/1970 | Demeter | |
| 4,643,357 A | | 2/1987 | Culbertson et al. | |
| 4,838,487 A | | 6/1989 | Schneider | |
| 4,919,333 A | | 4/1990 | Weinstein | |
| 4,943,005 A | | 7/1990 | Weinstein | |
| 4,997,130 A | * | 3/1991 | Weinstein | 239/224 |
| 5,106,025 A | | 4/1992 | Giroux et al. | |
| 5,378,505 A | * | 1/1995 | Kubota et al. | 427/484 |
| 5,511,830 A | * | 4/1996 | Olson et al. | 285/243 |
| 5,697,559 A | * | 12/1997 | Davis et al. | 239/703 |
| 5,707,009 A | | 1/1998 | Schneider | |
| 5,862,988 A | | 1/1999 | van der Steur | |
| 5,909,849 A | | 6/1999 | Yamasaki et al. | |
| 6,003,785 A | | 12/1999 | Duey | |
| 6,050,499 A | | 4/2000 | Takayama et al. | |

* cited by examiner

*Primary Examiner*—David A. Scherbel
*Assistant Examiner*—Davis Hwu
(74) *Attorney, Agent, or Firm*—Foley & Lardner

(57) ABSTRACT

A rotary atomizer for a coating apparatus has a bell shaped body, e.g., a bell cup, having a cavity and a detachable flow control device, e.g., face cover, that substantially closes a portion of the cavity. The two-piece construction eases maintenance, such as cleaning, and the manufacturability since the inside the bell cup is easily accessible from the mouth (wider opening) of the bell cup. After the face cover is detached, it can be reused or discarded for a new one. The bell cup further has cleaning channels that can direct cleaning agent directly onto the outer surface of the bell cup, without any reservoir or the like that can accumulate coating material.

50 Claims, 6 Drawing Sheets

ROTARY ATOMIZER AND BELL CUP AND METHODS THEREOF

BACKGROUND

An electrostatic painting device typically uses a rotary atomizer to atomize paint or coating material. A rotary atomizer typically includes a bell shaped body ("bell cup"), which is typically used, but not exclusively, in painting motor vehicles. The bell cup is mounted to one end of a rotatably mounted shaft, which is typically driven by an air motor. The bell cup is generally spun at a relatively high speed, to about 70,000 RPM, to generate sufficient centrifugal force to atomize the coating material exiting the bell cup's spray edge into a super fine mist.

Different bell cups may have different shapes and configuration to offer a variety of flow shapes and rates. Air can be supplied through a shroud that is concentrically positioned over the bell cup, adjacent to where the atomized coating material leaves the bell cup, to direct the atomized coating material to the object to be coated.

The bell shaped body can have a cavity defining an inner flow surface that communicates with the coating material source and a spray edge contiguous with the inner flow surface at the front or distal end of the bell shaped body. The bell cup is typically rotated around a stationary nozzle having a passageway or channel for the coating material.

One known problem with a bell cup atomizer is that coating material can accumulate on the outer exposed surfaces of the bell cup. During use, the accumulated (old) coating material can dislodge from the bell cup and undesirably mix with the new coating material, especially after changing the paint. Therefore, it is highly desirable to clean the outer surfaces of unwanted material.

One solution is to separately feed solvent or jet air to the outer peripheral surfaces to remove or prevent the unwanted material from adhering thereto. See for example, U.S. Pat. Nos. 5,862,988, 5,707,009, and 5,106,025. Another solution, as disclosed for example, in U.S. Pat. No. 5,707,009, uses a stationary nozzle having a plurality of channels that are separate from the coating material channel for delivering solvent to the inner flow surface and the outer surface of the bell cup. Since the solvent channels are independent from the coating material channel, the bell cup can be rinsed with solvent (rinsing or cleaning agent) without having to remove the paint from the paint channel. The feed nozzle, which is coaxially arranged with the bell cup, delivers solvent or coating material from the rear or proximal end of the bell cup through passages formed in the flow control device, e.g., an insert or face cover, of the bell cup.

In U.S. Pat. No. 5,707,009, the bell cup has an annular cavity located at the rear section of the bell cup, communicating with the solvent channels. The annular cavity creates a reservoir by which solvent flows via the rearward edge onto the outer periphery of the bell cup. During use, while the bell cup undergoes painting operation, the annular cavity is prone to paint accumulation. Thus, there is a need for a better way of cleaning the outer periphery of the bell cup. The present invention addresses this need.

Known bell-cup atomizers are typically monolithically formed (single-piece construction), typically machined from a single block of aluminum. In this vein, a typical bell cup atomizer has a bell cup integrally formed with a flow control device typically comprising a front cover or bell cone covering a portion of the cavity. The front cover or bell cone has a front side having exit passageways. The backside or the proximal end of the bell-cup atomizer has a rather relatively small passage through which the machining or cleaning is accomplished.

In practice, the atomized coating material can adhere to the surfaces of the bell cup and impede the flow of the coating material through the exit holes. Consequently, the bell cup must be cleaned frequently. Thorough cleaning of known bell cups entails detaching them from their manifold to access the internal surfaces. Even after detaching it, the narrower or smaller opening at the proximal end of the bell cup makes cleaning difficult.

Further, various stages of a coating operation may require different flow configurations of coating materials and, thus, require a different exit hole arrangement. With known bell cups, the entire bell-cup atomizer must be detached from the manifold, and an entire new bell-cup atomizer must be attached. This procedure must be repeated each time the coating operation calls for a change in the flow configuration of the coating material.

Accordingly, there is a need for a better way of accessing the internal surfaces of the bell-cup atomizer and a more economical way of manufacturing and using the same. In this respect, U.S. Pat. No. 5,707,009 addresses this problem with a detachable flow control device (insert) comprising a front cover and a ring unit. The present invention also addresses this need.

Further, a bell-cup atomizer with the integral flow control device or the detachable insert typically has radially or outwardly extending channels through which the paint exits. The bell-cup atomizer or the detachable insert can be formed with a curved or flat wall surface. The present inventor has found that paint can build up on that wall surface even after undergoing a wash cycle. Accordingly, there is a need for a bell-cup atomizer or detachable insert that stays cleaner around the exit side of the channels. The present invention also addresses this need.

SUMMARY

The present invention relates to a coating device, such as a rotary atomizer, a bell cup thereof, and a detachable flow control device thereof, and methods thereof. The rotary atomizer has a bell cup, i.e., a rotatable body. The bell cup can have a provision for cleaning the outer surface thereof and/or a provision for enabling access to inside, i.e., a cavity thereof, for easier cleaning and/or to alter the flow pattern.

The rotatable body can have a cavity defining an inner surface, an outer surface surrounding the cavity, and a spray edge located at a distal end of the rotatable body, where coating material to be atomized leaves the rotatably body. The rotatable body further can have a first axial passage through which a coating material to be atomized or a cleaning agent can be delivered to the cavity. The rotatable body has a plurality of cleaning passages extending from the first axial passage to the outer surface of the rotatable body. The cleaning passages are adapted to deliver cleaning agent to the outer surface. Moreover, the outer surface of the rotary body is deliberately devoid of any fluid accumulating recess or reservoir to enable the cleaning passages to feed the cleaning fluid onto the outer surface without accumulating or storing the cleaning agent or the coating material on the outer surface.

The rotatable body can be substantially bell shaped, having an open distal end and a proximal end opposite the distal end, and a hub portion extending axially from the proximal end of the bell shaped body. The outer surface can extend from the hub portion to the distal end. The first axial passage extends concentrically with the hub portion and extends through the proximal end of the bell shaped body to communicate the first axial passage with the cavity. The cleaning passages can extend outwardly and forwardly toward the proximal end of the bell shaped body.

The rotary atomizer can further include a rotatable shaft connected to the rotatable body. In this respect, the hub portion can include a first mechanical connector, such as external or male threads, and the rotatable shaft can include a second mechanical connector, such as internal or female threads, that is complementary to the first mechanical connector.

A stationary nozzle can be used to deliver the coating material and the cleaning agent. In this respect, the nozzle can have a first passage adapted to deliver the coating material to the cavity, at least one second passage adapted to deliver the cleaning agent to the cavity, and a third passage branching off from the second passage. The nozzle can extend into the first axial passage with a sufficient clearance to permit the rotatable body to freely rotate relative to the stationary nozzle. The distal end of the stationary nozzle can extend into the second axial passage with a sufficient clearance to permit the rotatable body to freely rotate relative to the stationary nozzle.

The first passage and the second passage both communicate with the cavity, and the third passage communicates with the cleaning passages to direct the cleaning agent to the outer surface. Because the outer surface is devoid of any fluid accumulating recess or reservoir according to the one aspect of the present invention, the cleaning passages can feed the cleaning fluid onto the outer surface without accumulating the cleaning agent or the coating material on the outer surface.

The bell cup can have a flow control device connected or mounted to the rotatable body, which flow control device substantially encloses a portion of the cavity. The flow control device can have a mounting member and a face cover having a front side, a rear side opposite the front side, the rear side facing toward the first axial passage. The mounting member extends from the rear side of the face cover into the first axial passage. The face cover has at least one passageway adjacent its periphery.

The mounting member can include a first mechanical connector and the bell shaped body can include a second mechanical connector that is complementary to the first mechanical connector. The first mechanical connector can comprise external threads and the second mechanical connector can comprise complementary internal threads. The flow control device can be attached or detached by rotating the flow control device relative to the bell shaped body. The internal threads can be formed in the first axial passage.

The face cover can be circular and spaced from a distal end of the first axial passage. The outer periphery of the circular face cover can be spaced from an inner surface to form an annular passageway or can sealingly abut the inner surface to form a plurality of passageways. The rear side and the inner surface define an internal chamber. The mounting member has a second axial passage communicating with the internal chamber and the first axial passage. The second axial passage is adapted to deliver the coating material to the internal chamber.

The flow control device can further include a sealing flange positioned between the first mechanical connector and the face cover. The first axial passage includes, at a distal end thereof, a seat for receiving the sealing flange. The flow control device can further include a plurality of substantially radially extending channels that communicate the second axial passage with the internal chamber. The substantially radially extending channels can be positioned between the sealing flange and the face cover.

The flow control device can further include a recessed cavity formed between the face cover and the sealing flange. The internal chamber is further defined by the recessed cavity. The recessed cavity can have an annular wall positioned between the face cover and the sealing flange. The radially extending channels open through the annular wall and form exit openings that are kept separated by the annular wall. The exit openings each are radiused to form a sharp longitudinal edge formed on the annular wall between two adjacent channels.

The flow control device can further include a center feed outlet at a center of the face cover. The center feed outlet can comprise a center passage communicating the internal chamber with the front side of the face cover and a plurality of substantially radially extending channels communicating with the center passage. The front side can be substantially planar and the substantially radially extending channels can extend substantially parallel to the planar front side.

Another aspect of the invention is a flow control device itself, having aforementioned face cover, mounting member, sealing flange, axial passage, plurality of substantially radially extending channels, and annular wall. Specifically, the face cover has a front side and a rear side opposite the front side. The mounting member extends from the rear side of the face cover and has a mechanical connector adapted for attachment to a complementary mechanical connector of a bell cup of the rotary atomizer. The sealing flange is positioned between the mounting member and the face cover. The axial passage extends through the mounting member and the sealing flange. The substantially radially extending channels communicate with the axial passage and are positioned between the sealing flange and the face cover. The annular wall is formed between the face cover and the sealing flange. The radially extending channels open through the annular wall and form exit openings kept separated by the annular wall. The exit openings each are radiused to form a sharp edge formed on the annular wall between two adjacent channels. The radius reduces the wall surface so that the paint exiting the channels has virtually no surface to accumulate. Thus, cleaning the bell becomes much more efficient.

According to another aspect of the invention, one method of delivering coating material and cleaning agent to a rotary atomizer comprises: providing the rotatable body having the cavity defining the inner surface, the outer surface surrounding the cavity, and the spray edge at the distal end of the rotatable body, where the coating material to be atomized leaves the rotatably body, with the outer surface that is devoid of any fluid accumulating recess or reservoir; providing the stationary nozzle having the first passage that delivers the coating material to the cavity, the second passage that delivers cleaning agent to the cavity, and the third passage branching off from the second passage; providing a first axial passage in the rotatable body and the cleaning passages in the rotatable body, extending from the first axial passage to the outer surface of the rotatable body; extending the stationary nozzle into the first axial passage with a sufficient clearance to permit the rotatable body to freely rotate relative to the stationary nozzle; feeding coating material through the first passage to deliver coating material to the cavity and thus to the spray edge while rotating the rotatable body or feeding cleaning agent to the cavity through the second passage and to the outer surface through the second and third passages and the cleaning passages while rotating the rotatable body.

Because the outer surface is devoid of any fluid accumulating recess or reservoir, the cleaning passages feed the cleaning fluid onto the outer surface without accumulating the cleaning agent or accumulation the coating material on the outer surface.

According to another aspect of the invention, a method of manufacturing a bell cup comprises: providing the bell shaped body having the cavity defining the inner surface, the outer surface surrounding the cavity, and the spray edge at a distal end of the rotatable body, where the coating material to be atomized leaves the rotatably body; providing the first axial passage in the rotatable body that communicates with the cavity; providing the flow control device comprising the face cover and the mounting member, the face cover having the front side, the rear side opposite the front side, the rear side facing toward the first axial passage, and wherein the mounting member extends from the rear side of the face cover into the first axial passage, and the face cover having a plurality of passageways adjacent its periphery; providing the first mechanical connector on the mounting member and the second mechanical connector that is complementary to the first mechanical connector on the first axial passage; and connecting the first and second mechanical connector.

Because the first and second mechanical connectors can be detachably connected, using, for example, threads or any suitable conventional mechanical connectors, the flow control device can be removed to fully expose the cavity and to readily replace the same for different flow control or spray pattern.

The present invention encompasses the above-described aspect or combination of the aspects described above, or other features described below.

BRIEF DESCRIPTION OF THE DRAWINGS

These and other features, aspects, and advantages of the present invention will become more apparent from the following description, appended claims, and accompanying exemplary embodiments shown in the drawings, which are briefly described below.

DETAILED DESCRIPTION

Figure 1:
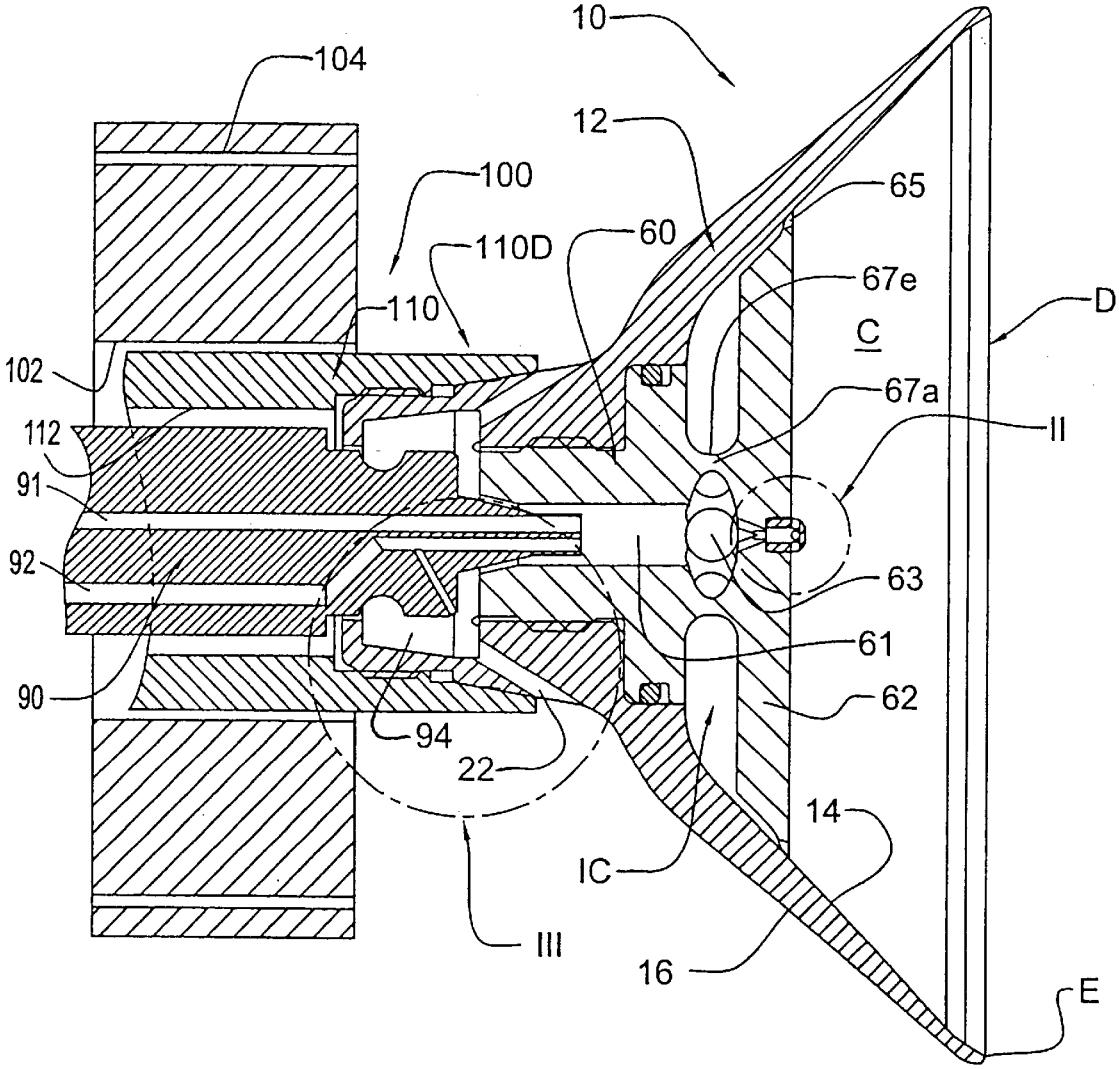
FIG. 1 illustrates a cross-sectional view of a bell-cup atomizer according to one embodiment of the present invention.

Same or corresponding elements of different embodiments are labeled with the same reference numerals. Any reference made below to directions in describing the structure is relative to the drawings (as normally viewed) for convenience. The directions are not intended to be taken literally or limit the present invention in any form.

FIGS. 1–5 illustrate an embodiment of a rotary atomizer according to the present invention. The rotary atomizer can be used for spraying a coating material, such as water-soluble or other pigmented paint. The rotary atomizer has a bell cup 10 that can be coupled to a rotatable shaft 110. The rotatable shaft 110 can be hollow with a sufficient clearance from a stationary injector or nozzle 90 so that it can spin relative to the stationary nozzle 90. A mounting shroud 100 has a through hole 102 for accommodating the rotatable shaft 110, which can be driven by a conventional motor, such as an air or pneumatic motor.

The bell cup 10 comprises a rotatable body 12 with a cavity C. The cavity C is defined by the rotatable body's inner surface 14 terminating at a spray edge E generally located at a distal end D of the rotatable body 12, where atomized coating material leaves the rotatably body 12. The rotatable body 12 also has an outer surface 16 surrounding the inner surface 14. The rotatable body 12 has a first axial passage 20 (see FIG. 4) through which a coating material to be atomized or a cleaning agent is delivered to the cavity C. The rotatable body 12 further has a plurality of cleaning channels or passages 22 extending from the first axial passage 20 to the outer surface 16 of the rotatable body 12. The illustrated embodiment includes eight such passages 22. But any desirable number of these passages 22 can be included, from a minimum of one, to as many as needed, depending on the desirable flow rate. The cleaning passages 22 are adapted to deliver cleaning agent to the outer surface 16 of the rotatable body 12.

According to one aspect of the invention, the outer surface 16 is deliberately devoid of any fluid accumulating recess or reservoir to enable the cleaning passages 22 to feed the cleaning fluid onto the outer surface 16 without accumulating the cleaning agent or the coating material on the outer surface 16.

Figure 4:
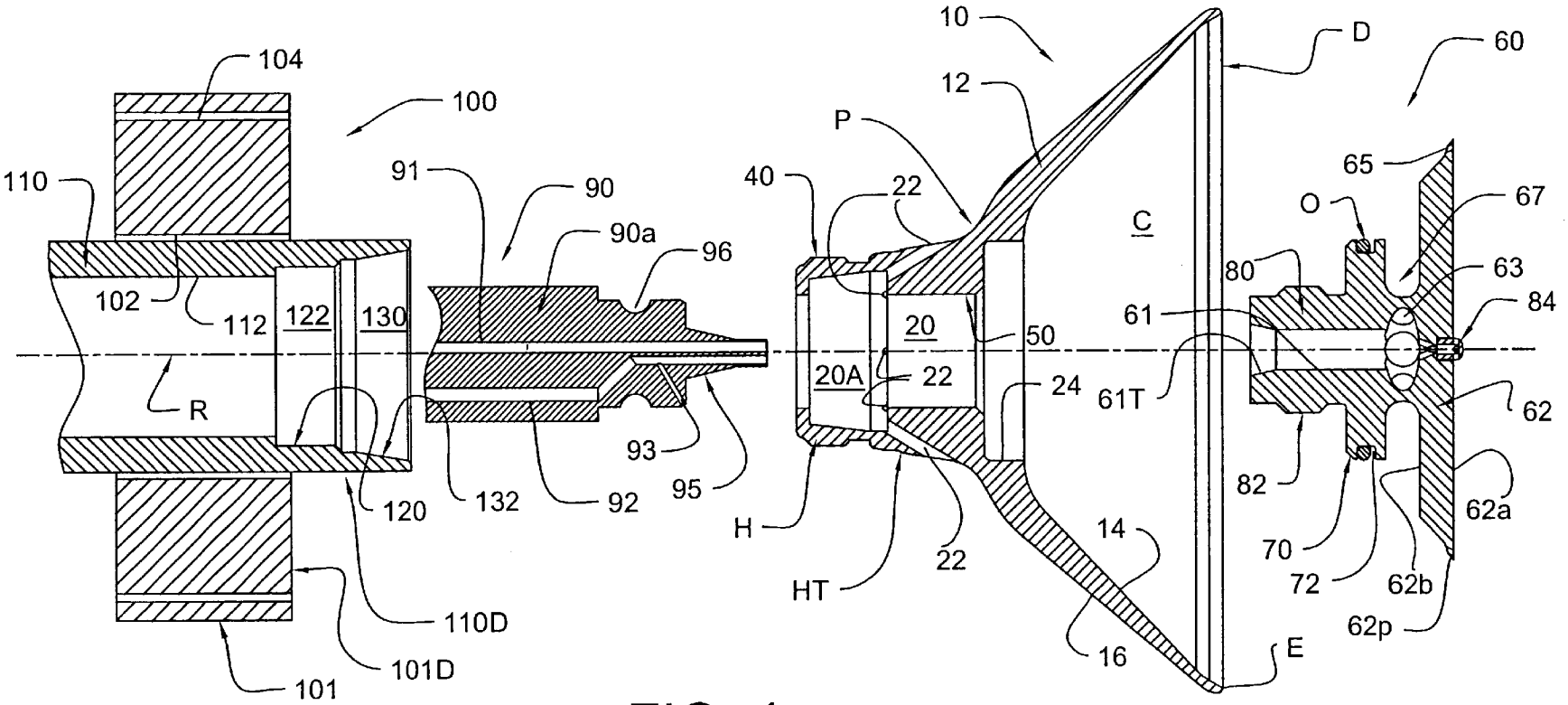
FIG. 4 is an exploded view of the bell-cup atomizer of FIG. 1.

The rotatable body 12 can be bell shaped, having an open distal end D and a proximal end P opposite the distal end D, and a hub portion H extending axially away from the proximal end P thereof. In this respect, the bell-shaped body 12 can have a substantially conical configuration, with the inner and outer surfaces 14, 16 being substantially conical as shown in FIGS. 1 and 4. The outer surface 16 of the bell shaped body 12 can be defined as extending from about the exit opening of the cleaning passages 22 to the distal end D or the spray edge E.

The first axial passage 20 extends concentrically with and through the hub portion H and extends through the proximal end P of the bell shaped body 12 to communicate the first axial passage 20 with the cavity C. The cleaning passages 22 extend outwardly and forwardly from the first axial passage 20, from the hub portion H, and terminate adjacent to the proximal end P (i.e., the distal end of the hub portion H) of the bell shaped body 12. The cleaning passages 22 extend at an acute angle relative to the first axial passage 20, and can be equally distributed around the hub portion H.

Referring to FIG. 4, the stationary nozzle 90 comprises a cylindrical body 90*a* with a first passage 91 adapted to deliver the coating material, at least one second passage 92 adapted to deliver cleaning agent, and a third passage 93 branching off from the second passage 92. The first passage 91 extends axially, but can be slightly offset from the rotation axis R. The second passage 92 also extends axially, but offset from the rotation axis R and the first passage 91.

Figure 3:
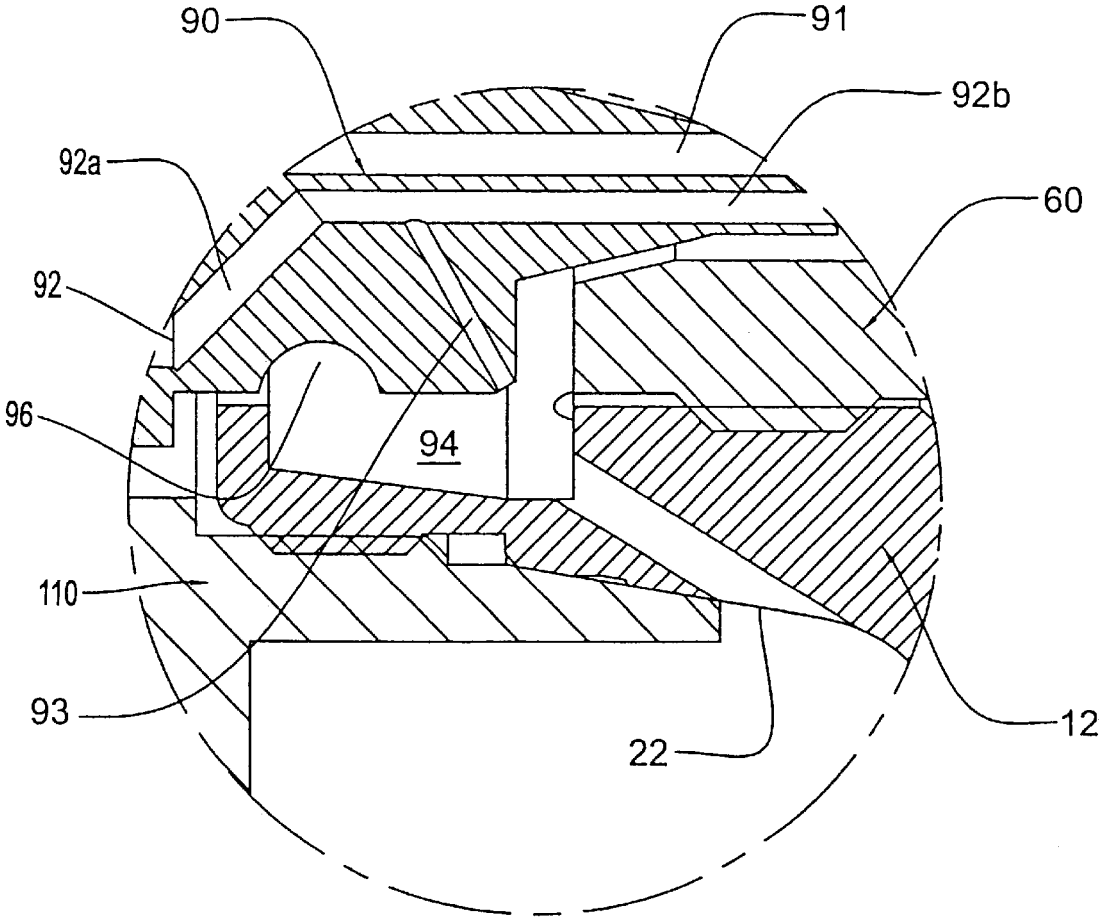
FIG. 3 is an enlarged view of section III of FIG. 1.

Referring to FIG. 3, the second passage 92, at its distal end portion, has an inwardly angled entry pathway 92*a*, followed by an axially extending discharge pathway 92*b*, which extends parallel with the first passage 91. The nozzle 90 also has a tapered or conical distal head portion 95 (FIG. 4) at which the first and second passages 91, 92 extend parallel.

Although, the embodiment illustrated here shows a single second passage 92, additional second passages 92 can be added if desired. In that case, the first passage 91 can be coaxial with the rotation axis R and the second passages 92 can be distributed around the first passage 91.

The distal end portion of the stationary nozzle 90 extends into the first axial passage 20 with a sufficient clearance to permit the rotatable body to freely rotate relative to the stationary nozzle 90. The third passage 93 communicates with the second passage 92 and terminates axially adjacent to the entry of the cleaning passages 22. The distal end portion of the stationary nozzle 90 is inserted into the first axial passage 20 so that the third passage 93 ends near or close to where the cleaning passages 22 open into the first axial passage 20.

The first passage 91 and the second passage 92 both communicate with the cavity C. The third passage 93 communicates with the cleaning passages 22 to direct the cleaning agent to the outer surface 16, via a clearance space 94 formed between the flow control device 60, 60A (FIGS. 4 and 5) and the stationary nozzle 90. The first axial passage 20 includes a distal portion 20A that has a larger dimension to provide the clearance space 94. The cleaning passages 22 extend from the distal portion 20A to the outer surface 16 of the rotatable body. Moreover, the nozzle 90 includes an annular recess 96 to provide additional clearance space. Because the outer surface 16 is devoid of any fluid accumulating recess or reservoir, the cleaning passages 22 can feed the cleaning fluid directly onto the outer surface 16.

The bell cup 10 includes a detachable flow control device 60, 60A concentrically disposed inside the bell shaped body 12 to substantially enclose or block a portion of the cavity C, forming an internal chamber IC (FIG. 1). The flow control device 60, 60A comprises a face cover 62 and a mounting member 80. The face cover 62 has a front side 62*a*, a rear side 62*b* opposite to the front side 62*a*, the rear side 62*b* facing the first axial passage 20. The mounting member 80 extends from the rear side 62*b* of the face cover 62 into the first axial passage 20.

Figure 7:
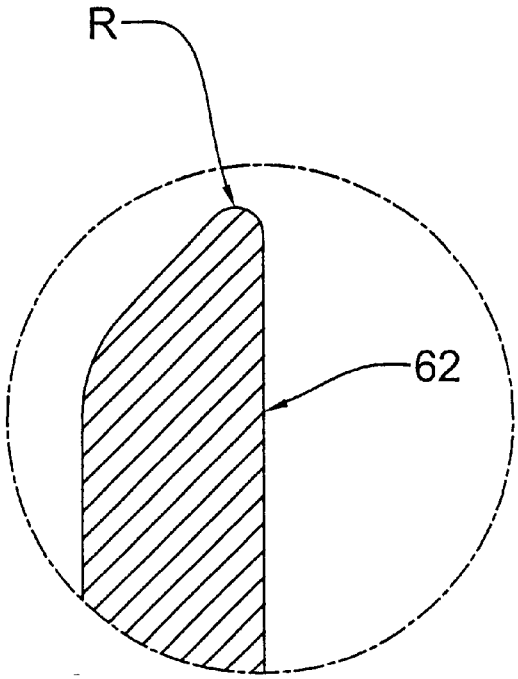
FIG. 7 is an enlarged cross-sectional view of section VII of FIG. 5.

The face cover 62 is circular and spaced from a distal end of the first axial passage 20. In the embodiment illustrated in FIGS. 1 and 4, the face cover 62 has a plurality of evenly spaced notches or serrations that form a plurality of passageways 65 with the inner surface 14. The circular periphery 62*p* of the face cover 62 in this embodiment can have sharp peripheral edges that sealingly abut the inner surface 14. The rear side 62*b* and a portion of the inner surface 14 confined by the face cover 62 define the internal chamber IC. In the embodiment illustrated in FIGS. 5 and 7, the face cover 62 has a rounded edge R that is spaced away from the inner surface 14 to provide an annular passageway (i.e., predetermined gap) therebetween instead of a plurality of passageways 65.

The mounting member 80 includes a first mechanical connector 82. The bell shaped body 12 has a second mechanical connector 50 that is complementary to the first mechanical connector 82. The first mechanical connector 82 can comprise external threads and the second mechanical connector 50 can comprise complementary internal threads formed on the first axial passage 20. The flow control device 60, 60A is attached or detached by rotating the flow control device 60, 60A relative to the bell shaped body 12.

Figure 5:
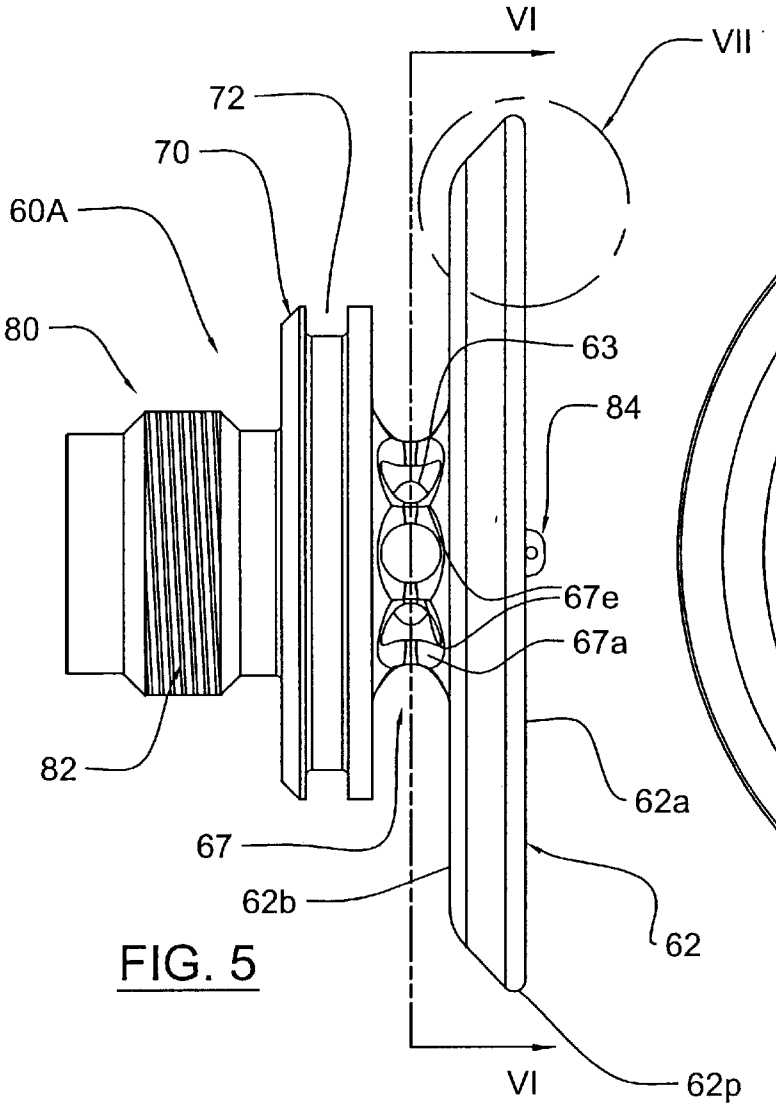
FIG. 5 illustrates an alternative embodiment of a detachable insert illustrated in FIG. 1.

The flow control device 60, 60A can be detachably mounted via threads, as shown in FIG. 5. The first and second mechanical connectors 82, 50, however, can be other conventional means of removably attaching or coupling two bodies, such as a bayonet mount, keyed or splined coupling, snap-fit, interference fit, etc. This enables replacement of the flow control device 60, 60A after usage, such as during an overhaul, and eases maintenance and manufacturability of the bell cup 10.

The flow control device 60, 60A can further include a sealing flange 70 positioned between the first mechanical connector 82 and the face cover 62. The sealing flange 70 is cylindrical and can be dimensioned the same as or wider than the first mechanical connector 82. The flange 70 has a groove 72 for receiving and seating an O-ring O or the like. At a distal end of the first axial passage 20, the bell shaped body 12 includes a seat 24. The seat 24 comprises a cylindrical recess that extends collinearly and concentrically with the first axial passage 20 at its distal end. The cylindrical recess 24 is dimensioned to seat the sealing flange 70. The O-ring O is designed to seal the flange 70 against the seat 24, and prevent coating material from leaking.

The flow control device 60, 60A has a second axial passage 61 (center channel) that communicates with the internal chamber IC and the first axial passage 20. The second axial passage 61 extends axially through the first mechanical connector 82 and the sealing flange 70 and delivers the coating material/cleaning agent to the internal chamber IC. The second axial passage 61 extends to the backside 62*b* of the faceplate 62. The entry or proximal end 61T of the center channel 61 is tapered 61T and configured complementary with the tapered distal head portion 95 of the nozzle 90. A sufficient clearance is provided between the head portion 95 and the center channel 61 to allow the bell cup 10 to rotate relative to the nozzle 90 without contacting any portion of the nozzle 90. The nozzle 90 remains stationary while the bell cup 10 rotates.

The flow control device 60, 60A further includes a plurality of substantially radially or outwardly extending channels 63 that communicate the second axial passage 61 with the internal chamber IC. The outwardly extending channels 63 can be positioned between the sealing flange 70 and the face cover 62.

The flow control device 60 has a plurality of outlet passageways 65 distributed around adjacent its outer periphery, which passageways 65 communicate with the cavity C. In this embodiment, cleaning agent or coating material discharges to the exposed cavity C through the channels 63 and passageways 65. In the second embodiment (FIG. 5), the flow control device 60A forms a continuous annular gap between the peripheral edge 62*p* and the inner surface 14 of the bell cup 10 to form a passageway. In the second embodiment, cleaning agent or coating material discharges to the exposed cavity C through the channels 63 and the annular gap.

Figure 2:
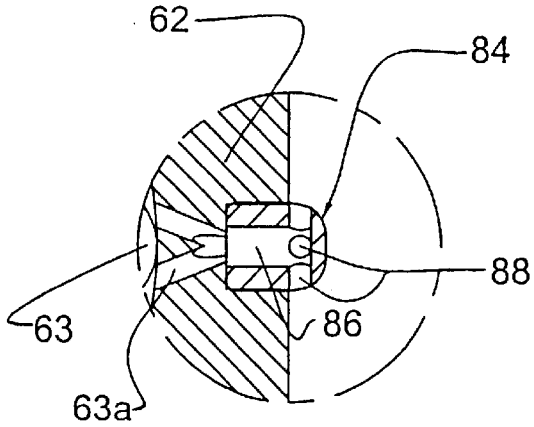
FIG. 2 is an enlarged view of section II of FIG. 1.

Referring to FIG. 2, the flow control device 60, 60A can further include a center feed outlet 84 at a center of the faceplate 62. The center feed outlet 84 comprises a center passage 86 communicating the internal chamber IC with the front side 62*a* of the face cover 62 and a plurality of channels or passages 88 communicating with the center passage 86, which communicates with a plurality of feeding passages 63*a* formed through the faceplate 62. The channels 63 communicate with the center passage 86 through the plurality of entry openings of the feeding passages 63*a*. The feeding passages 63*a* are angled so that they converge into the center passage 86. The front side 62*a* can be substantially planar and the channels 88 can extend substantially parallel to the planar front side 62*a*. The center feed outlet 84 can discharge cleaning agent to clean the front face 62*a* of the faceplate 62. In this respect, the radially extending passages 88 direct cleaning agent parallel to the front face 62*a*. This is achieved by having the passages 88 aligned parallel to the front face 62*a* and radially outwardly directed. Cleaning agent can be thus delivered through the passages 88 to clean the front face 62*a,* and through the channels 63 to clean the internal chamber IC and the inner surface 14 of the bell shaped body 12.

Referring to FIGS. 1 and 4, the bell cup 10 is adapted to be connected to a hollow rotatable shaft 110, which has a passage 112. In this respect, the hub portion H can include a mechanical connector 40, such as external or male threads, and the rotatable shaft 110 can include a mechanical connector 120, such as internal or female threads, that is complementary to the mechanical connector 40, similar to the first and second mechanical connectors 82, 50 of the flow control device 60, 60A and the rotatable body 12. These mechanical connectors 40, 120 also can be other conventional complementary means of attaching or coupling two bodies, such as a bayonet mount, keyed or splined coupling, etc.

The mounting shroud 100 comprises a substantially cylindrical member 101 with a central through hole 102 dimensioned to pass the hollow rotatable shaft 110 with a sufficient clearance. The rotatable shaft 110 extends coaxially with the cylindrical member 101 and can be rotatably journaled relative to the cylindrical member 101. The rotatable shaft 110 can be directly driven, which can be driven by an air or pneumatic motor (not shown), or connected to another driven hollow shaft, so that rotatable shaft 110 spins the bell cup 10, while the stationary nozzle 90 and the cylindrical member 101 are maintained stationary.

The distal end portion 110D of the rotatable shaft 110 can protrude beyond the distal end 101D of the cylindrical member 101, toward the hub portion H. The fastener 120 comprises a first recess 122. The first recess 122 is substantially cylindrical and can extend toward the distal end portion 110D of the rotatable shaft 110, extending beyond the cylindrical member 101. The first recess 122 can be concentric with the passage 112 and can have internal threads that are complementary with the external threads on the hub portion H. As explained before, the mechanical fastener can be any other suitable conventional means, such as the ones identified previously.

The rotatable shaft 110 further has a second recess 130, concentric with the passage 112, extending collinearly from the first recess 122. The second recess 130 is substantially cylindrical, with a conical section 132 that tapers out to form a wider mouth at the distal end portion of the passage 112. The conical section 132 is complementary to a tapered section HT of the hub portion H so that when the bell cup 10 is mounted to the rotatable shaft 110, the tapered section HT and the conical section 132 abut each other. The distal end of the rotatable shaft 110 ends before the exit openings of the cleaning passages 22.

The cylindrical member 101 also includes a plurality of axially extending passages 104 distributed about its periphery. The passages 104 can direct compressed air jets to the outer surface 16 of the bell cup 10 to direct coating material away from the outer surface 16 and prevent the coating material from sticking thereto, and/or to shape the atomized coating material.

In operation, when the coating material is changed, or to wash the bell cup 10, cleaning agent, is directed through the passage 92 instead of feeding the coating material through the passage 91. Cleaning agent is discharged through the first and second solvent passages 92, 93 when the bell cup needs rinsing (without paint change) to eliminate the need to use the coating material passage 91 and reduce paint loss. The axial pathway 92*b* feeds cleaning agent to the flow control device 60, 60A, which delivers cleaning agent through the passageways 86, 88 to clean the flow control device front face 62*a,* and through the channels 63 to clean the internal chamber IC, and the inner surface 14. Some cleaning agent also branches into the third passage 93 from the second passage 92. Cleaning agent then enters the clearance space 94. Some cleaning agent flows through the cleaning passages 22, which communicate with the outer surface 16, and some cleaning agent can bleed or seep into the second axial passage 61, which communicates with the internal chamber IC, through the clearance space between the tapered nozzle head portion 95 and the tapered entry 61T. Cleaning agent is delivered through the cleaning passages 22 to the distal end of the hub portion H, to access the entire backside of the outer surface 16. Because there is no recess, cavity, reservoir, or equivalent of any kind at the backside of the outer surface that would accumulate solvent (or coating material for that matter), the solvent channels 22 communicate directly with the outer surface 16. And because the backside does not have any place to harbor coating material, the bell cup 10 will require less maintenance, and will be easier to manufacture.

Typically, a bell cup 10 is machined from an aluminum alloy, and is integrally formed with the flow control device, bell cone, or face cover, which makes machining more difficult and complicated. By providing a removable flow control device 60, 60A, which can be made from plastics or aluminum alloy, or any other durable and light material, the inner surface 14 of the bell cup 10 becomes accessible for machining and cleaning. During the bell-cup cleaning operation, the flow control device 60, 60A may be removed, if needed, by unthreading, cleaned with a bristle brush, and then reinserted back into the same bell cup 10, or simply replaced. When the flow control device 60, 60A is removed, the inner surface 14 of the bell cup 10 becomes completely exposed for easy cleaning.

Referring to FIGS. 1 and 5, the internal chamber IC is defined by a portion of the inner surface 14 and a recessed cavity 67 formed between the front cover 62 and the sealing flange 70. An annular wall 67*a* is formed between the front cover 62 and the sealing flange 70 and defines the inner chamber IC along with the front cover 62, the sealing flange 70, and the inner surface 14. The channels 63 extend through the annular wall 67*a* and form exit openings at the periphery of the annular wall 67. The wall 67*a* separates the exit openings of the adjacent channels 63, as illustrated in FIG. 6.

Figure 9:
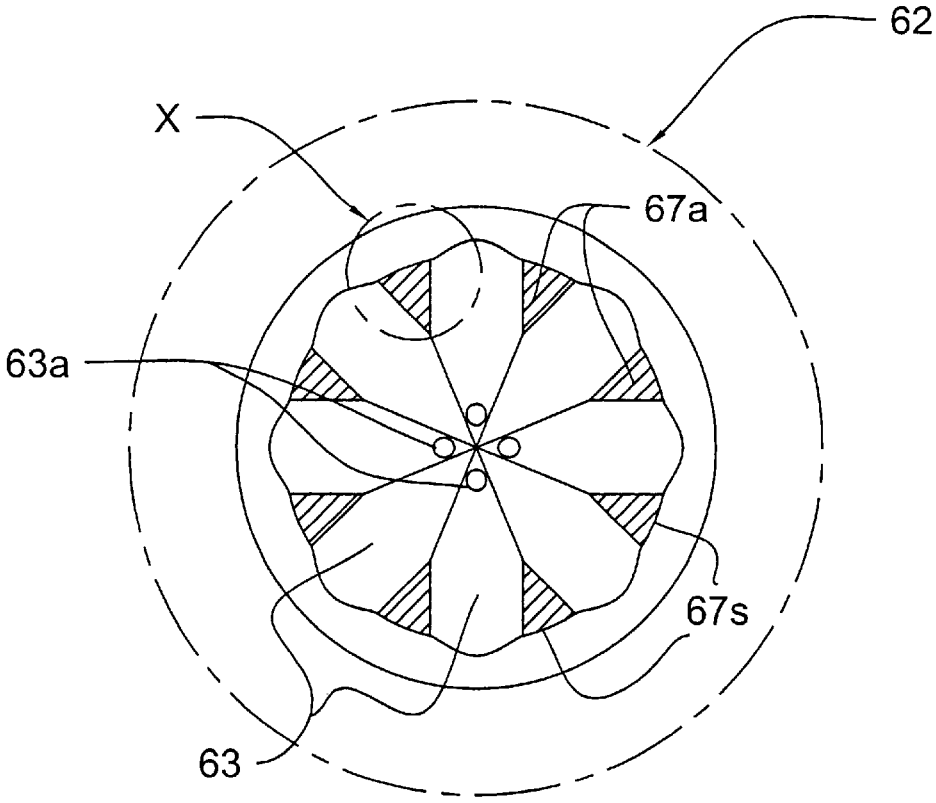
FIG. 9 illustrates a cross-sectional view similar to FIG. 6 for purposes of illustrating an external wall surface that can accumulate paint.
Figure 10:
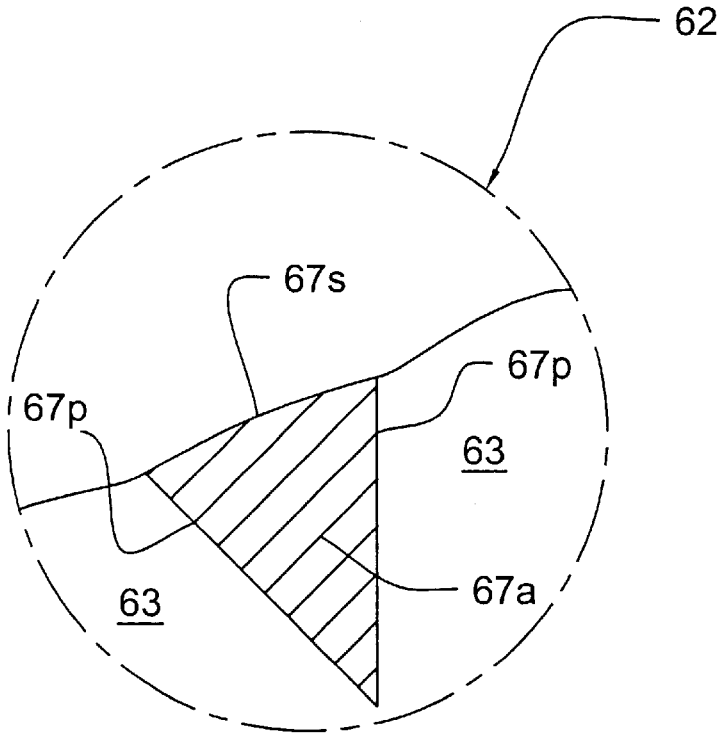
FIG. 10 is an enlarged cross-sectional view of section X of FIG. 9.

Referring to FIGS. 9 and 10, the present inventor discovered that the outer wall surface 67*s* of the wall 67*a* can accumulate paint. The accumulated paint will remain there even after a bell wash cycle. The present inventor discovered a solution to this problem.

Figure 6:
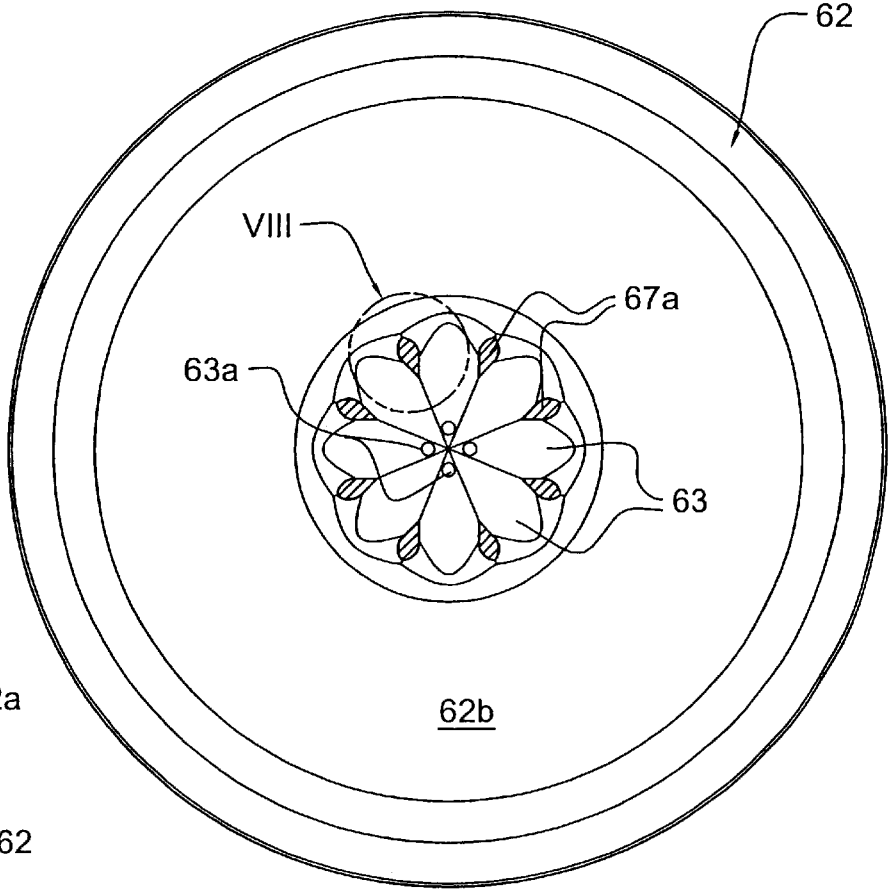
FIG. 6 is a cross-sectional view taken along line VI—VI of FIG. 5 (cross-sectional view of the detachable insert illustrated in FIG. 1 being identical).
Figure 8:
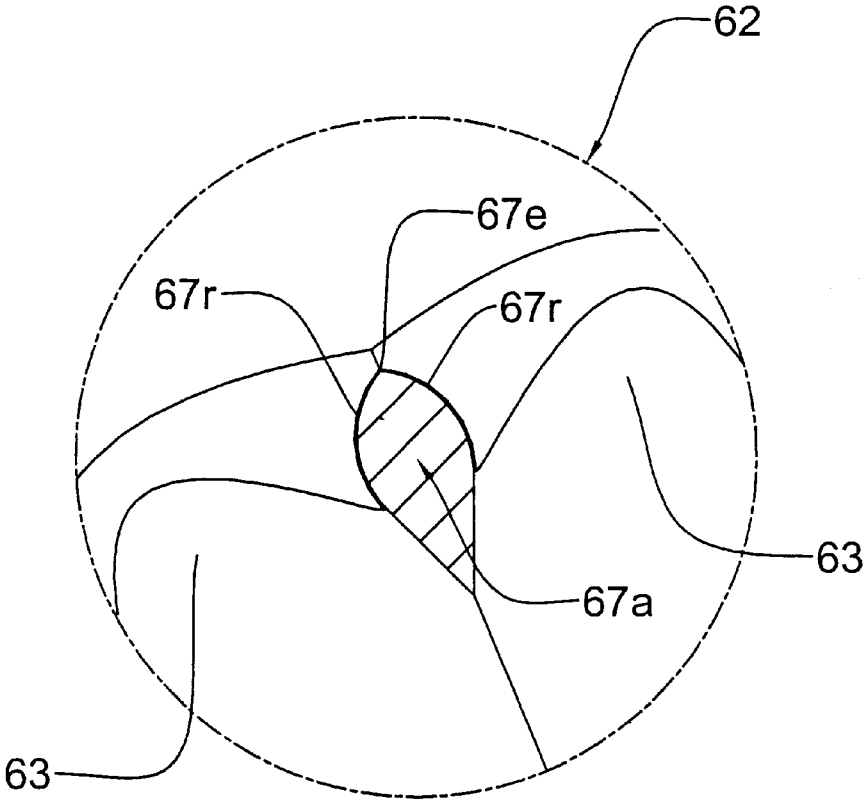
FIG. 8 is an enlarged view of section VIII of FIG. 6.

Referring to FIGS. 5, 6, and 8, the present inventor contemplates solving this problem by beveling or removing portions 67*p* (see FIG. 10) of the wall 67*a* at the exit openings of the channels 63. For example, in the embodiment shown in FIG. 8, a radius 67*r* has been added to each exit opening of the channel 63 so that a sharp edge 67*e* is formed on the wall 67*a* between the two adjacent channels 63. The radius 67*r* reduces the wall surface 67*s* to an edge 67*e*. With this configuration, the paint exiting the channels 63 has virtually no surface to accumulate. Thus, the bell wash cleaning becomes more effective.

The removable flow control device 60, 60A adds the benefit of interchangeability, according to particular coating requirements. A different spray pattern or flow rate may be achieved by simply replacing one flow control device 60, 60A with another, rather than replacing the entire bell cup 10.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. The scope of the present invention accordingly is to be defined as set forth in the appended claims.

What is claimed is:

1. A rotary atomizer comprising:

a bell cup having a rotatable body, the rotatable body having a cavity defining an inner surface, an outer surface surrounding the cavity, and a spray edge located at a distal end of the rotatable body, where coating material to be atomized leaves the rotatable body; and a stationary nozzle having a first passage adapted to deliver the coating material to the cavity, at least one second passage adapted to deliver cleaning agent to the cavity, and a third passage branching off from the second passage, wherein the rotatable body has a first axial passage and a plurality of cleaning passages extending from the first axial passage to the outer surface of the rotatable body, the cleaning passages being adapted to deliver cleaning agent to the outer surface, wherein the stationary nozzle extends into the first axial passage with a sufficient clearance to permit the rotatable body to freely rotate relative to the stationary nozzle, wherein the first passage and the second passage both communicate with the cavity, and the third passage communicates with the cleaning passages to direct the cleaning agent to the outer surface, and wherein the outer surface is devoid of any fluid accumulating recess or reservoir to enable the cleaning passages to feed the cleaning fluid onto the outer surface without accumulating the cleaning agent or the coating material on the outer surface.

2. A rotary atomizer according to claim 1, wherein the rotatable body is substantially bell shaped and has an open distal end and a proximal end opposite the distal end, and a hub portion extending axially from the proximal end of the bell shaped body, the outer surface extending from the hub portion to the distal end, and wherein the first axial passage extends concentrically with the hub portion and extends through the proximal end of the bell shaped body to communicate the first axial passage with the cavity.

3. A rotary atomizer according to claim 2, wherein the cleaning passages extend outwardly and forwardly toward the proximal end of the bell shaped body.

4. A rotary atomizer according to claim 2, further comprising: a flow control device connected to the bell shaped body to control the flow of the coating material.

5. A rotary atomizer according to claim 4, wherein the flow control device is detachably connected to the bell shaped body.

6. A rotary atomizer according to claim 2, further comprising: a flow control device having a face cover and a mounting member, the face cover having a front side, a rear side opposite the front side, the rear side facing toward the first axial passage, and wherein the mounting member extends from the rear side of the face cover to the first axial passage, the face cover having at least one passageway adjacent its periphery.

7. A rotary atomizer according to claim 6, wherein the face cover is circular and spaced from a distal end of the first axial passage, the outer periphery of the circular face cover is spaced from an inner surface to form an annular passageway or sealingly abuts the inner surface to form a plurality of passageways, and the rear side and the inner surface define an internal chamber.

8. A rotary atomizer according to claim 6, wherein the flow control device is removably attached to the bell shaped body.

9. A rotary atomizer according to claim 6, wherein the mounting member includes a first mechanical connector and the bell shaped body has a second mechanical connector that is complementary to the first mechanical connector.

10. A rotary atomizer according to claim 9, wherein the first mechanical connector comprises external threads and the second mechanical connector comprises complementary internal threads, the flow control device being attached or detached by rotating the flow control device relative to the bell shaped body.

11. A rotary atomizer according to claim 10, wherein the internal threads are formed in the first axial passage.

12. A rotary atomizer according to claim 2, further comprising: a rotatable shaft connected to the rotatable body, wherein the hub portion includes a first mechanical connector and the rotatable shaft includes a second mechanical connector that is complementary to the first mechanical connector.

13. A rotary atomizer comprising:

a bell cup having a rotatable body, the rotatable body having a cavity defining an inner surface, an outer surface surrounding the cavity, and a spray edge located at a distal end of the rotatable body, where coating material to be atomized leaves the rotatable body;

a stationary nozzle having a first passage adapted to deliver the coating material to the cavity, at least one second passage adapted to deliver cleaning agent to the cavity, and a third passage branching off from the second passage; and a flow control device having a face cover and a mounting member, the face cover having a front side, a rear side opposite the front side, the rear side facing toward the first axial passage, wherein the rotatable body has a first axial passage and a plurality of cleaning passages extending from the first axial passage to the outer surface of the rotatable body, the cleaning passages being adapted to deliver cleaning agent to the outer surface, wherein the stationary nozzle extends into the first axial passage with a sufficient clearance to permit the rotatable body to freely rotate relative to the stationary nozzle, wherein the first passage and the second passage both communicate with the cavity, and the third passage communicates with the cleaning passages to direct the cleaning agent to the outer surface, wherein the outer surface is devoid of any fluid accumulating recess or reservoir to enable the cleaning passages to feed the cleaning fluid onto the outer surface without accumulating the cleaning agent or the coating material on the outer surface, wherein the rotatable body is substantially bell shaped and has an open distal end and a proximal end opposite the distal end, and a hub portion extending axially from the proximal end of the bell shaped body, the outer surface extending from the hub portion to the distal end, wherein the first axial passage extends concentrically with the hub portion and extends through the proximal end of the bell shaped body to communicate the first axial passage with the cavity, wherein the mounting member extends from the rear side of the face cover to the first axial passage, the face cover having at least one passageway adjacent its periphery, wherein the mounting member includes a first mechanical connector and the bell shaped body has a second mechanical connector that is complementary to the first mechanical connector, wherein the first mechanical connector comprises external threads and the second mechanical connector comprises complementary internal threads, the flow control device being attached or detached by rotating the flow control device relative to the bell shaped body, wherein the internal threads are formed in the first axial passage, wherein the face cover is circular and spaced from a distal end of the first axial passage, the outer periphery of the circular face cover is spaced from an inner surface to form an annular passageway or sealingly abuts the inner surface to forms a plurality of passageways, and the rear side and the inner surface define an internal chamber, and wherein the mounting member has a second axial passage communicating with the internal chamber and the first axial passage, the second axial passage being adapted to deliver the coating material to the internal chamber.

14. A rotary atomizer according to claim 13, wherein the flow control device further includes a sealing flange positioned between the first mechanical connector and the face cover and the first axial passage includes, at a distal end thereof, a seat for receiving the sealing flange.

15. A rotary atomizer according to claim 14, wherein the flow control device further includes a plurality of substantially radially extending channels that communicate the second axial passage with the internal chamber, the substantially radially extending channels being positioned between the sealing flange and the face cover.

16. A rotary atomizer according to claim 15, wherein the flow control device includes a recessed cavity formed between the face cover and the sealing flange, the internal chamber being further defined by the recessed cavity, the recessed cavity having an annular wall positioned between the face cover and the sealing flange, the radially extending channels opening through the annular wall and forming exit openings kept separated by the annular wall.

17. A rotary atomizer according to claim 16, wherein the exit openings each are radiused to form a sharp longitudinal edge formed on the annular wall between two adjacent channels.

18. A rotary atomizer comprising:

a bell cup having a rotatable body, the rotatable body having a cavity defining an inner surface, an outer surface surrounding the cavity, and a spray edge located at a distal end of the rotatable body, where coating material to be atomized leaves the rotatable body;

a stationary nozzle having a first passage adapted to deliver the coating material to the cavity, at least one second passage adapted to deliver cleaning agent to the cavity, and a third passage branching off from the second passage; and a flow control device having a face cover and a mounting member, the face cover having a front side, a rear side opposite the front side, the rear side facing toward the first axial passage, wherein the rotatable body has a first axial passage and a plurality of cleaning passages extending from the first axial passage to the outer surface of the rotatable body, the cleaning passages being adapted to deliver cleaning agent to the outer surface, wherein the stationary nozzle extends into the first axial passage with a sufficient clearance to permit the rotatable body to freely rotate relative to the stationary nozzle, wherein the first passage and the second passage both communicate with the cavity, and the third passage communicates with the cleaning passages to direct the cleaning agent to the outer surface, wherein the outer surface is devoid of any fluid accumulating recess or reservoir to enable the cleaning passages to feed the cleaning fluid onto the outer surface without accumulating the cleaning agent or the coating material on the outer surface, wherein the rotatable body is substantially bell shaped and has an open distal end and a proximal end opposite the distal end, and a hub portion extending axially from the proximal end of the bell shaped body, the outer surface extending from the hub portion to the distal end, wherein the first axial passage extends concentrically with the hub portion and extends through the proximal end of the bell shaped body to communicate the first axial passage with the cavity, wherein the mounting member extends from the rear side of the face cover to the first axial passage, the face cover having at least one passageway adjacent its periphery, wherein the face cover is circular and spaced from a distal end of the first axial passage, the outer periphery of the circular face cover is spaced from an inner surface to form an annular passageway or sealingly abuts the inner surface to form a plurality of passageways, and the rear side and the inner surface define an internal chamber, and wherein the mounting member has a second axial passage communicating with the internal chamber and the first axial passage, the second axial passage being adapted to deliver the coating material to the internal chamber.

19. A rotary atomizer according to claim 18, wherein the flow control device further includes a center feed outlet at a center of the face cover.

20. A rotary atomizer according to claim 19, wherein the center feed outlet comprises a center passage communicating the internal chamber with the front side of the face cover and a plurality of substantially radially extending channels communicating with the center passage.

21. A rotary atomizer according to claim 20, wherein the front side is substantially planer and the substantially radially extending channels extend substantially parallel to the planar front side.

22. A rotary atomizer according to claim 18, wherein a distal end of the stationary nozzle extends into the second axial passage.

23. A bell cup for a rotary atomizer, comprising:

a rotatable body having a cavity defining an inner surface, an outer surface surrounding the cavity, and a spray edge located at a distal end of the rotatable body, where coating material to be atomized leaves the rotatable body; and wherein the rotatable body has a first axial passage through which a coating material to be atomized or a cleaning agent is adapted to be delivered to the cavity, and a plurality of cleaning passages extending from the first axial passage to the outer surface of the rotatable body, the cleaning passages being adapted to deliver cleaning agent to the outer surface, wherein the outer surface is devoid of any fluid accumulating recess or reservoir to enable the cleaning passages to feed the cleaning fluid onto the outer surface without accumulating the cleaning agent or the coating material on the outer surface.

24. A bell cup according to claim 23, wherein the rotatable body is substantially bell shaped and has an open distal end and a proximal end opposite the distal end, and a hub portion extending axially from the proximal end, the outer surface extending from the hub portion to the distal end of the bell shaped body, and wherein the axial passage extends concentrically with the hub portion and extends through the proximal end to communicate the first axial passage with the cavity.

25. A bell cup according to claim 23, wherein the cleaning passages extend outwardly and forwardly toward the proximal end of the bell shaped body.

26. A bell cup according to claim 23, further comprising: a flow control device connected to the bell shaped body to control the flow of the coating material.

27. A bell cup according to claim 26, wherein the flow control device is detachably connected to the bell shaped body.

28. A bell cup according to claim 23, further comprising: a flow control device comprising a face cover and a mounting member, the face cover having a front side, a rear side opposite the front side, the rear side facing toward the first axial passage, and wherein the mounting member extends from the rear side of the face cover into the first axial passage, and the face cover having at least one passageway adjacent its periphery.

29. A bell cup according to claim 28, wherein the face cover is circular and spaced from a distal end of the first axial passage, the outer periphery of the circular face cover is spaced from an inner surface to form an annular passageway or sealingly abuts the inner surface to form a plurality of passageways, and the rear side and the inner surface define an internal chamber.

30. A bell cup according to claim 28, wherein the flow control device is removably attached to the bell shaped body.

31. A bell cup according to claim 28, wherein the mounting member includes a first mechanical connector and the bell shaped body has a second mechanical connector that is complementary to the first mechanical connector.

32. A bell cup according to claim 31, wherein the first mechanical connector is external threads and the second mechanical connector is complementary internal threads, the flow control device being attached or detached by rotating the flow control device relative to the bell shaped body.

33. A bell cup according to claim 32, wherein the internal threads are formed in the first axial passage.

34. A bell cup for a rotary atomizer, comprising:

a rotatable body having a cavity defining an inner surface, an outer surface surrounding the cavity, and a spray edge located at a distal end of the rotatable body, where coating material to be atomized leaves the rotatable body; and a flow control device comprising a face cover and a mounting member, the face cover having a front side, a rear side opposite the front side, the rear side facing toward the first axial passage, wherein the rotatable body has a first axial passage through which a coating material to be atomized or a cleaning agent is adapted to be delivered to the cavity, and a plurality of cleaning passages extending from the first axial passage to the outer surface of the rotatable body, the cleaning passages being adapted to deliver cleaning agent to the outer surface, wherein the outer surface is devoid of any fluid accumulating recess or reservoir to enable the cleaning passages to feed the cleaning fluid onto the outer surface without accumulating the cleaning agent or the coating material on the outer surface, wherein the mounting member extends from the rear side of the face cover into the first axial passage, and the face cover having at least one passageway adjacent its periphery, wherein the mounting member includes a first mechanical connector and the bell shaped body has a second mechanical connector that is complementary to the first mechanical connector, wherein the first mechanical connector is external threads and the second mechanical connector is complementary internal threads, the flow control device being attached or detached by rotating the flow control device relative to the bell shaped body, wherein the internal threads are formed in the first axial passage, wherein the face cover is circular and spaced from a distal end of the first axial passage, the outer periphery of the circular face cover is spaced from an inner surface to form an annular passageway or sealingly abuts the inner surface to form a plurality of passageways, and the rear side and the inner surface define an internal chamber, and wherein the mounting member has a second axial passage communicating with the internal chamber and the first axial passage, the second axial passage being adapted to deliver the coating material to the internal chamber.

35. A bell cup according to claim 34, wherein the flow control device further includes a sealing flange positioned between the first connector and the face cover and the first axial passage includes, at a distal end thereof, a seat for receiving the sealing flange.

36. A bell cup according to claim 35, wherein the flow control device further includes a plurality of substantially radially extending channels that communicate the second axial passage with the internal chamber, the substantially radially extending channels being positioned between the sealing flange and the face cover.

37. A bell cup according to claim 36, wherein the flow control device includes a recessed cavity formed between the face cover and the sealing flange, the internal chamber being further defined by the recessed cavity, the recessed cavity having an annular wall positioned between the face cover and the sealing flange, the radially extending channels opening through the annular wall and forming exit openings kept separated by the annular wall.

38. A bell cup according to claim 37, wherein the exit openings each are radiused to form a sharp longitudinal edge formed on the annular wall between two adjacent channels.

39. A bell cup for a rotary atomizer, comprising:

a rotatable body having a cavity defining an inner surface, an outer surface surrounding the cavity, and a spray edge located at a distal end of the rotatable body, where coating material to be atomized leaves the rotatable body; and a flow control device comprising a face cover and a mounting member, the face cover having a front side, a rear side opposite the front side, the rear side facing toward the first axial passage, wherein the rotatable body has a first axial passage through which a coating material to be atomized or a cleaning agent is adapted to be delivered to the cavity, and a plurality of cleaning passages extending from the first axial passage to the outer surface of the rotatable body, the cleaning passages being adapted to deliver cleaning agent to the outer surface, wherein the outer surface is devoid of any fluid accumulating recess or reservoir to enable the cleaning passages to feed the cleaning fluid onto the outer surface without accumulating the cleaning agent or the coating material on the outer surface, wherein the mounting member extends from the rear side of the face cover into the first axial passage, and the face cover having at least one passageway adjacent its periphery, wherein the flow control device is removably attached to the bell shaped body, wherein the face cover is circular and spaced from a distal end of the first axial passage, the outer periphery of the circular face cover is spaced from an inner surface to form an annular passageway or sealingly abuts the inner surface to form a plurality of passageways, and the rear side and the inner surface define an internal chamber, and wherein the mounting member has a second axial passage communicating with the internal chamber and the first axial passage, the second axial passage being adapted to deliver the coating material to the internal chamber.

40. A bell cup according to claim 39, wherein the flow control device further includes a center feed outlet at a center of the face cover.

41. A bell cup according to claim 40, wherein the center feed outlet comprises a center passage communicating the internal chamber with the front side of the face cover and a plurality of substantially radially extending channels communicating with the center passage.

42. A bell cup according to claim 41, wherein the front side is substantially planar and the substantially radially extending channels extend substantially parallel to the planar front side.

43. A detachable flow control device for a rotary atomizer, comprising:

a face cover having a front side and a rear side opposite the front side;

a mounting member extending from the rear side of the face cover the face, the mounting member having a mechanical connector adapted for attachment to a complementary mechanical connector of a bell cup of the rotary atomizer;

a sealing flange positioned between the mounting member and the face cover;

an axial passage extending through the mounting member and the sealing flange;

a plurality of substantially radially extending channels communicating with the axial passage, the substantially radially extending channels being positioned between the sealing flange and the face cover; and an annular wall formed between the face cover and the sealing flange, the radially extending channels opening through the annular wall and forming exit openings kept separated by the annular wall;

wherein the exit openings each are radiused to form a sharp edge formed on the annular wall between two adjacent channels.

44. A flow control device according to claim 43, further comprising: a recessed cavity defined between the face cover, the annular wall, and the sealing flange, wherein the sharp edge is longitudinally oriented.

45. A flow control device according to claim 44, wherein the mechanical connector is external threads on the mounting member.

46. A flow control device according to claim 43, wherein the face cover is circular and spaced from a distal end of the axial passage, the outer periphery of the circular face cover is adapted to be spaced from an inner surface of the bell cup to form an annular passageway or adapted to sealingly abut the inner surface to form a plurality of passageways, and the rear side and the inner surface being adapted to define an internal chamber, and wherein the axial passage extending through the mounting member and the sealing flange communicates with the internal chamber.

47. A method of delivering coating material and cleaning agent to a rotary atomizer, comprising:

providing a rotatable body having a cavity defining an inner surface, an outer surface surrounding the cavity, and a spray edge located at a distal end of the rotatable body, where the coating material to be atomized leaves the rotatable body, the outer surface of the rotatable body being devoid of any fluid accumulating recess or reservoir;

providing a stationary nozzle having a first passage that delivers the coating material to the cavity, at least one second passage that delivers cleaning agent to the cavity, and a third passage branching off from the second passage;

providing a first axial passage in the rotatable body and a plurality of cleaning passages in the rotatable body, the cleaning passages extending from the first axial passage to the outer surface of the rotatable body;

extending the stationary nozzle into the first axial passage with a sufficient clearance to permit the rotatable body to freely rotate relative to the stationary nozzle;

feeding coating material through the first passage to deliver coating material to the cavity and thus to the spray edge while rotating the rotatable body or feeding cleaning agent to the cavity through the second passage and to the outer surface through the second and third passages and the cleaning passages while rotating the rotatable body, wherein the outer surface devoid of any fluid accumulating recess or reservoir enables the cleaning passages to feed the cleaning fluid onto the outer surface without accumulating the cleaning passages or accumulation the coating material on the outer surface.

48. A method of manufacturing a bell cup, comprising:

providing a bell shaped rotatable body having a cavity defining an inner surface, an outer surface surrounding the cavity, and a spray edge located at a distal end of the rotatable body, where the coating material to be atomized leaves the rotatable body;

providing a first axial passage in the rotatable body that communicates with the cavity;

providing a flow control device comprising a face cover, which is positioned substantially in a central region of the cavity, and a mounting member, the face cover having a front side, a rear side opposite the front side, the rear side facing toward the first axial passage, and wherein the mounting member extends from the rear side of the face cover into the first axial passage, and the face cover having at least one passageway adjacent its periphery;

providing a first mechanical connector on the mounting member and a second mechanical connector that is complementary to the first mechanical connector on the first axial passage; and connecting the first and second mechanical connector.

49. A method according to claim 48, wherein the first mechanical connector comprises external threads and the second mechanical connector comprises complementary internal threads formed on the first axial passage, the flow control device being attached or detached by rotating the flow control device relative to the bell shaped body.

50. A method according to claim 48, further comprising providing cleaning passages that communicate the first axial passage with the outer surface to enable delivery of the cleaning agent to the outer surface.

* * * * *